US006298563B1

(12) United States Patent
Yeadon

(10) Patent No.: US 6,298,563 B1
(45) Date of Patent: Oct. 9, 2001

(54) ELECTRIC CAN OPENER WITH A HORIZONTALLY ORIENTED BLADE

(76) Inventor: Kathy Yeadon, 81-03 Hammels Blvd. #4E, Rockaway Beach, NY (US) 11693

( * ) Notice: Subject to any disclaimer, the term of this patent is extended or adjusted under 35 U.S.C. 154(b) by 0 days.

(21) Appl. No.: 09/456,718

(22) Filed: Dec. 8, 1999

(51) Int. Cl.[7] ..... B67B 7/46
(52) U.S. Cl. ..... 30/418; 30/434
(58) Field of Search ..... 30/418, 421, 422, 30/425, 427, 417, 410, 436, 442

(56) References Cited

U.S. PATENT DOCUMENTS

| | | | | |
|---|---|---|---|---|
| 2,286,303 | * | 6/1942 | Pearson | 30/418 |
| 2,825,963 | * | 3/1958 | Sykes et al. | 30/410 |
| 3,313,023 | * | 4/1967 | Jepson et al. | 30/410 |
| 3,348,305 | * | 10/1967 | Bielak | 30/418 |
| 4,251,917 | * | 2/1981 | Peres | 30/421 |
| 4,561,182 | * | 12/1985 | Yamamoto et al. | 30/410 |
| 4,831,735 | * | 5/1989 | Bast et al. | 30/410 |
| 6,088,921 | * | 7/2000 | Valento | 30/410 |

* cited by examiner

*Primary Examiner*—Boyer Ashley
*Assistant Examiner*—Omar Flores Sánchez
(74) *Attorney, Agent, or Firm*—Goldstein Law Offices, P.C

(57) ABSTRACT

An electric can opener with a horizontally oriented blade including a base portion having a generally C-shaped configuration. The base portion includes a lower horizontal portion, a vertical portion, and an upper horizontal portion. The base portion includes an upper housing secured to and extending upwardly from the upper horizontal portion. A motor is disposed within the upper housing of the base portion. A rotating magnet is secured to the upper horizontal portion of the base portion. The rotating magnet is in communication with the motor whereby activation of the motor will rotate the magnet. The magnet engages the closed upper end of the can. A cutting member is secured to the upper horizontal portion of the base portion. The cutting member is positioned to engage the can downwardly of the closed upper end thereof when the can is engaged by the rotating magnet.

4 Claims, 2 Drawing Sheets

ELECTRIC CAN OPENER WITH A HORIZONTALLY ORIENTED BLADE

BACKGROUND OF THE INVENTION

The present invention relates to an electric can opener with a horizontally oriented blade and more particularly pertains to opening cans without leaving sharp edges.

The use of can openers is known in the prior art. More specifically, can openers heretofore devised and utilized for the purpose of opening cans are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,858,313 to Yamaguchi discloses an electric can opener with means to automatically rotate and open a can. U.S. Pat. No. 2,673,058 to Tyler and U.S. Pat. No. 4,831,735 to Bast disclose additional electric can opening devices. U.S. Pat. No. Des. 191,266 to Madl discloses an ornamental design for a can opener.

While these devices fulfill their respective, particular objective and requirements, the aforementioned patents do not describe an electric can opener with a horizontally oriented blade for opening cans without leaving sharp edges.

In this respect, the electric can opener with a horizontally oriented blade according to the present invention substantially departs from the conventional concepts and designs of the prior art, and in doing so provides an apparatus primarily developed for the purpose of opening cans without leaving sharp edges.

Therefore, it can be appreciated that there exists a continuing need for a new and improved electric can opener with a horizontally oriented blade which can be used for opening cans without leaving sharp edges. In this regard, the present invention substantially fulfills this need.

SUMMARY OF THE INVENTION

In the view of the foregoing disadvantages inherent in the known types of can openers now present in the prior art, the present invention provides an improved electric can opener with a horizontally oriented blade. As such, the general purpose of the present invention, which will be described subsequently in greater detail, is to provide a new and improved electric can opener with a horizontally oriented blade which has all the advantages of the prior art and none of the disadvantages.

To attain this, the present invention essentially comprises a base portion having a generally C-shaped configuration. The base portion includes a lower horizontal portion having a first end and a second end. The second end is bifurcated. The base portion includes a vertical portion having an upper end and a lower end. The lower end is secured to the first end of the lower horizontal portion. The base portion includes an upper horizontal portion having a first end, a second end, an upper surface and a lower surface. The first end of the upper horizontal portion is secured to the upper end of the vertical portion whereby the upper horizontal portion is parallel to the lower horizontal portion. The base portion includes an upper housing secured to and extending upwardly from the second end of the upper horizontal portion. A motor is disposed within the upper housing of the base portion. A rotating magnet is secured to the lower surface of the upper horizontal portion of the base portion. The rotating magnet is in communication with the motor whereby activation of the motor will rotate the magnet. The magnet engages the closed upper end of the can. A cutting member is secured to the lower surface of the upper horizontal portion of the base portion. The cutting member includes an arm pivotally coupled with the upper horizontal portion. The arm has an upper surface and a lower surface. The cutting member includes a circular blade secured to the lower surface of the arm. The cutting blade is positioned to engage the can downwardly of the closed upper end thereof when the can is engaged by the rotating magnet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electric can opener with a horizontally oriented blade which has all the advantages of the prior art can openers and none of the disadvantages.

It is another object of the present invention to provide a new and improved electric can opener with a horizontally oriented blade which may be easily and efficiently manufactured and marketed.

It is a further object of the present invention to provide a new and improved electric can opener with a horizontally oriented blade which is of durable and reliable construction.

An even further object of the present invention is to provide a new and improved electric can opener with a horizontally oriented blade which is susceptible of a low cost of manufacture with regard to both materials and labor, and which accordingly is then susceptible of low prices of sale to the consuming public, thereby making such an electric can opener with horizontally oriented blade economically available to the buying public.

Even still another object of the present invention is to provide a new and improved electric can opener with a horizontally oriented blade for opening cans without leaving sharp edges.

Lastly, it is an object of the present invention to provide a new and improved electric can opener with a horizontally oriented blade including a base portion having a generally C-shaped configuration. The base portion includes a lower horizontal portion, a vertical portion, and an upper horizontal portion. The base portion includes an upper housing secured to and extending upwardly from the upper horizontal portion. A motor is disposed within the upper housing of the base portion. A rotating magnet is secured to the upper horizontal portion of the base portion. The rotating magnet is in communication with the motor whereby activation of the motor will rotate the magnet. The magnet engages the closed upper end of the can. A cutting member is secured to the upper horizontal portion of the base portion. The cutting member is positioned to engage the can downwardly of the closed upper end thereof when the can is engaged by the rotating magnet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
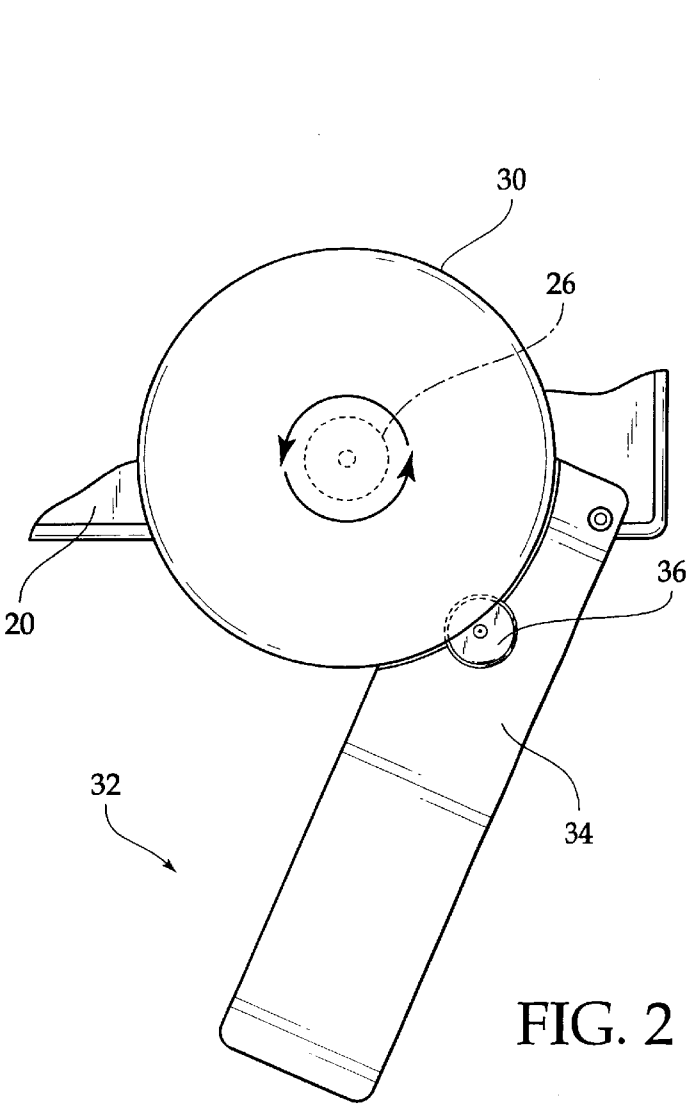
FIG. 2 is a partial bottom plan view of the present invention.
Figure 1:
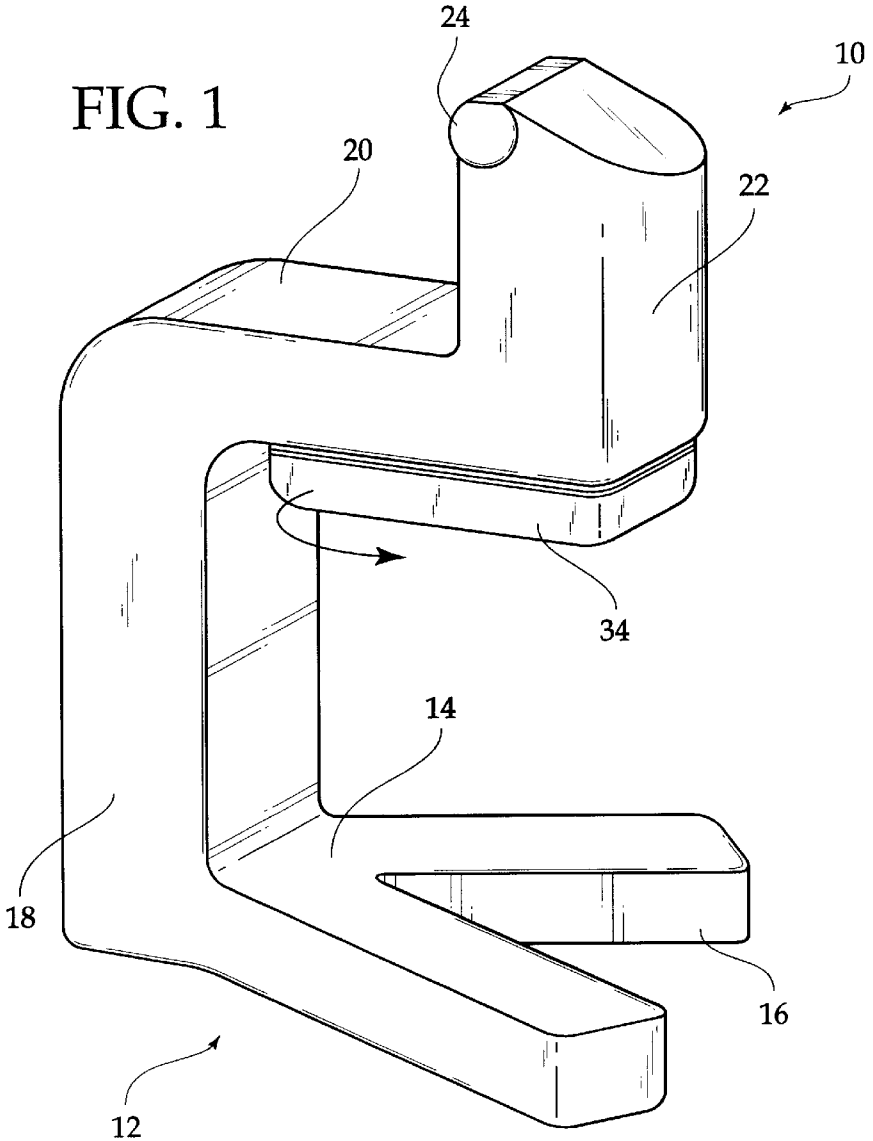
FIG. 1 is a perspective view of the preferred embodiment of the electric can opener with a horizontally oriented blade constructed in accordance with the principles of the present invention.
Figure 4:
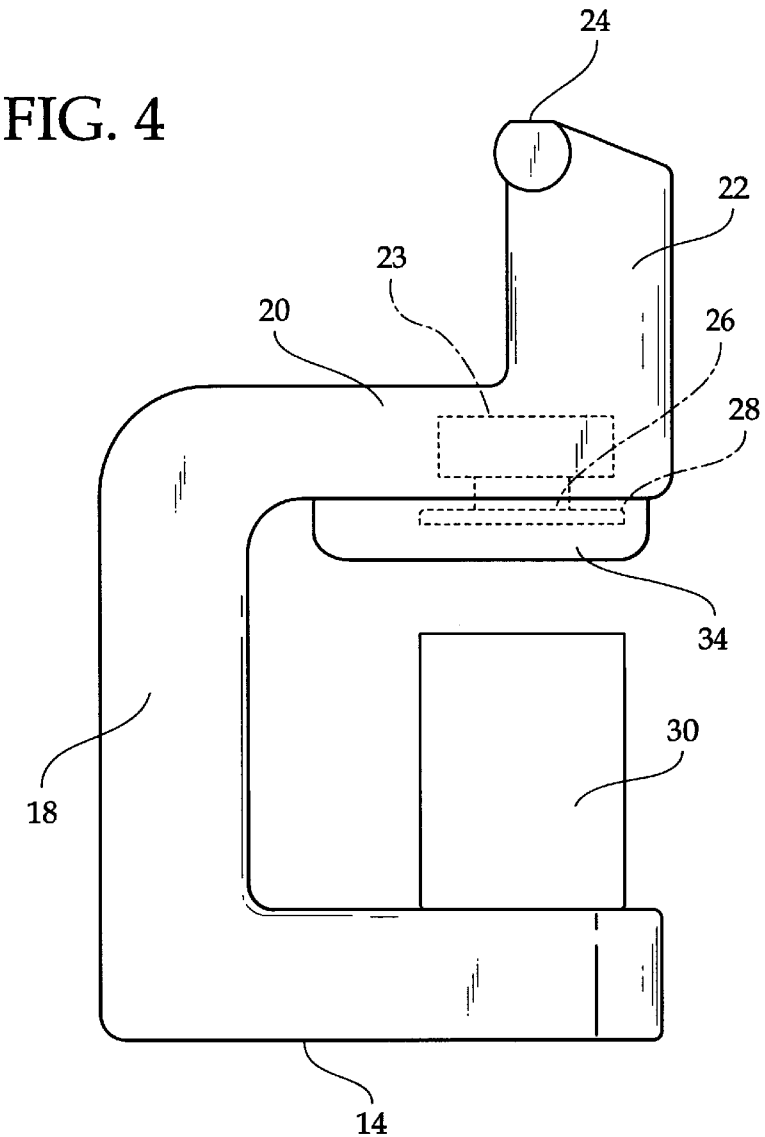
FIG. 4 is a side view of the present invention illustrating the removal of a top of a can.
Figure 3:
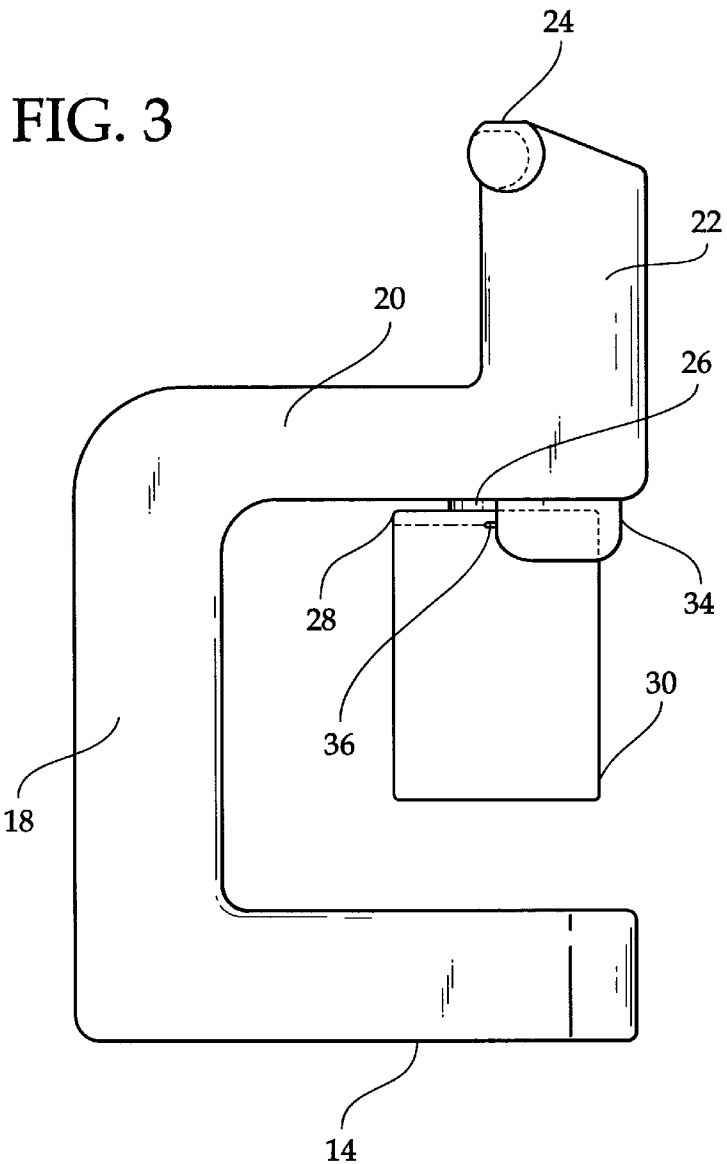
FIG. 3 is a side view of the present invention illustrated in use.

With reference now to the drawings, and in particular, to FIGS. 1 through 4 thereof, the preferred embodiment of the new and improved electric can opener with a horizontally oriented blade embodying the principles and concepts of the present invention and generally designated by the reference number 10 will be described.

Specifically, it will be noted in the various Figures that the device relates to an electric can opener with a horizontally oriented blade for opening cans without leaving sharp edges. In its broadest context, the device consists of a base portion, a motor, a rotating magnet, and a cutting member. Such components are individually configured and correlated with respect to each other so as to attain the desired objective.

The base portion 12 has a generally C-shaped configuration. The base portion 12 includes a lower horizontal portion 14 having a first end and a second end. The second end is bifurcated 16. Note FIG. 1. The base portion 12 includes a vertical portion 18 having an upper end and a lower end. The lower end is secured to the first end of the lower horizontal portion 14. The base portion 12 includes an upper horizontal portion 20 having a first end, a second end, an upper surface and a lower surface. The first end of the upper horizontal portion 20 is secured to the upper end of the vertical portion 18 whereby the upper horizontal portion 20 is parallel to the lower horizontal portion 14. The base portion 12 includes an upper housing 22 secured to and extending upwardly from the second end of the upper horizontal portion 20.

The motor [not illustrated] is disposed within the upper housing 22 of the base portion 12. The motor 23 includes a power source, preferably a battery, which can be accessed through an upper removable panel 24.

The rotating magnet 26 is secured to the lower surface of the upper horizontal portion 20 of the base portion 12. The rotating magnet 26 is in communication with the motor 23 whereby activation of the motor 23 will rotate the magnet 26. The magnet 26 engages the closed upper end 28 of the can 30.

The motor (not illustrated) is disposed within the upper housing 22 of the base portion 12. The motor includes a power source, preferably a battery, which can be accessed through an upper removable panel 24.

The rotating magnet 26 is secured to the lower surface of the upper horizontal portion 20 of the base portion 12. The rotating magnet 26 is in communication with the motor whereby activation of the motor will rotate the magnet 26. The magnet 26 engages the closed upper end 28 of the can 30.

The cutting member 32 is secured to the lower surface of the upper horizontal portion 20 of the base portion 12. The cutting member 32 includes an arm 34 pivotally coupled with the upper horizontal portion 20. The arm 34 has an upper surface and a lower surface. The cutting member 32 includes a circular blade 36 secured to the lower surface of the arm 34. The cutting blade 36 is positioned to engage the can 30 downwardly of the closed upper end 28 thereof when the can 30 is engaged by the rotating magnet 26. Note FIGS. 2 and 3.

In use, the arm 34 is pivoted outwardly so that the can 30 can be positioned with the closed upper end 28 engaged by the rotating magnet 26. Note FIGS. 2 and 3. The motor is then activated to cause the can 30 to rotate. The arm 34 is then pivoted inwardly so the circular blade 36 can engage the can 30. Once a single revolution has finished, the can 30 will be opened and the contents thereof can be removed. Note FIG. 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An electric can opener with a horizontally oriented blade for opening a can having a closed upper end without leaving sharp edges comprising, in combination:

a base portion having a generally C-shaped configuration, the base portion including a lower horizontal portion having a first end and a second end, the second end being bifurcated, the base portion including a vertical portion having an upper end and a lower end, the lower end secured to the first end of the lower horizontal portion, the base portion including an upper horizontal portion having a first end, a second end, an upper surface and a lower surface, the first end of the upper horizontal portion secured to the upper end of the vertical portion whereby the upper horizontal portion is parallel to the lower horizontal portion, the base portion including an upper housing secured to and extending upwardly from the second end of the upper horizontal portion;

a motor disposed within the upper housing of the base portion;

a rotating magnet secured to the lower surface of the upper horizontal portion of the base portion, the rotating magnet being in communication with the motor whereby activation of the motor will rotate the magnet, the magnet engaging the closed upper end of the can;

a cutting member secured to the lower surface of the upper horizontal portion of the base portion, the cutting member including an arm pivotally coupled with the upper horizontal portion, the arm having an upper surface and a lower surface, the cutting member including a circular blade secured to the lower surface of the arm, the cutting blade being positioned to engage the can downwardly of the closed upper end thereof when the can is engaged by the rotating magnet.

2. An electric can opener with a horizontally oriented blade for opening a can having a closed upper end without leaving sharp edges comprising, in combination:

a base portion having a generally C-shaped configuration, the base portion including a lower horizontal portion, a vertical portion and an upper horizontal portion, the upper horizontal portion being parallel to the lower horizontal portion, the base portion including an upper housing secured to and extending upwardly from the upper horizontal portion;

a motor disposed within the upper housing of the base portion;

a rotating magnet secured to the upper horizontal portion of the base portion, the rotating magnet being in communication with the motor whereby activation of the motor will rotate the magnet;

a cutting member secured to the upper horizontal portion of the base portion, the cutting member being positioned to engage the can downwardly of the closed upper end thereof when the can is engaged by the rotating magnet.

3. The electric can opener with a horizontally oriented blade as set forth in claim 2 wherein the lower horizontal portion of the base member has a bifurcated outer end.

4. The electric can opener with a horizontally oriented blade as set forth in claim 2 wherein the cutting member includes an arm pivotally coupled with the upper horizontal portion, the arm having an upper surface and a lower surface, the cutting member including a circular blade secured to the lower surface of the arm, the cutting blade being positioned to engage the can downwardly of the closed upper end thereof when the can is engaged by the rotating magnet.

* * * * *